US007490672B2

(12) United States Patent
Hollier

(10) Patent No.: US 7,490,672 B2
(45) Date of Patent: Feb. 17, 2009

(54) SYSTEM AND METHOD FOR PROCESSING DRILLING CUTTINGS DURING OFFSHORE DRILLING

(75) Inventor: Chad Hollier, Lafayette, LA (US)

(73) Assignee: Baker Hughes Incorporated, Houston, TX (US)

( * ) Notice: Subject to any disclaimer, the term of this patent is extended or adjusted under 35 U.S.C. 154(b) by 289 days.

(21) Appl. No.: 11/222,650

(22) Filed: Sep. 9, 2005

(65) Prior Publication Data

US 2007/0056740 A1 Mar. 15, 2007

(51) Int. Cl.
*E21B 29/12* (2006.01)
*E21B 21/00* (2006.01)

(52) U.S. Cl. ..... 166/357; 166/267; 175/206; 175/5

(58) Field of Classification Search ..... 166/267, 166/357, 105.5; 175/206, 5
See application file for complete search history.

(56) References Cited

U.S. PATENT DOCUMENTS

| | | | | |
|---|---|---|---|---|
| 5,256,289 | A | 10/1993 | Cope et al. | |
| 5,380,266 | A | 1/1995 | Leung et al. | |
| 5,520,605 | A | 5/1996 | Leung et al. | |
| 6,170,580 | B1 * | 1/2001 | Reddoch | 175/66 |
| 6,179,071 | B1 * | 1/2001 | Dietzen | 175/66 |
| 6,261,417 | B1 | 7/2001 | Iwashige | |
| 6,267,250 | B1 | 7/2001 | Leung et al. | |
| 6,267,899 | B1 * | 7/2001 | Greig et al. | 210/781 |
| 6,315,813 | B1 * | 11/2001 | Morgan et al. | 95/23 |
| 6,357,526 | B1 * | 3/2002 | Abdel-Halim et al. | 166/272.3 |
| 6,415,877 | B1 | 7/2002 | Fincher et al. | |
| 6,506,310 | B2 * | 1/2003 | Kulbeth | 210/780 |
| 6,527,054 | B1 * | 3/2003 | Fincher et al. | 166/357 |
| 6,640,912 | B2 | 11/2003 | Reddoch | |
| 6,752,273 | B2 | 6/2004 | Reddoch | |
| 6,763,605 | B2 | 7/2004 | Reddoch | |
| 6,793,814 | B2 * | 9/2004 | Fout et al. | 210/188 |
| 6,910,411 | B2 | 6/2005 | Reddoch | |
| 6,988,567 | B2 * | 1/2006 | Burnett et al. | 175/66 |
| 7,152,682 | B2 * | 12/2006 | Hopper | 166/357 |
| 2003/0070840 | A1 | 4/2003 | Boer | |
| 2003/0224920 | A1 | 12/2003 | Leung | |
| 2004/0182605 | A1 * | 9/2004 | Seyffert et al. | 175/5 |

FOREIGN PATENT DOCUMENTS

| | | |
|---|---|---|
| GB | 2061750 | * 10/1981 |
| GB | 2297702 | * 8/1996 |

* cited by examiner

*Primary Examiner*—Thomas A Beach
(74) *Attorney, Agent, or Firm*—Madan Mossman and Sriram

(57) ABSTRACT

A cuttings processing system processes return fluid recovered while drilling a wellbore at an offshore location. The processing system includes a separator having an inlet receiving the return fluid, an accelerator coupled to the inlet that accelerates the return fluid, and a conical spinning member that receives the accelerated return fluid from the accelerator and applies a centrifugal force to the return fluid. The acceleration provides the return fluid with a tangential velocity that substantially matches the rotational speed of the conical spinning member. The separator also has a liquid discharge port that discharging the substantially liquid component to a tank or pipe and a solids discharge opening that discharges the substantially solid component out of the separator. In one embodiment, a conveyance device transports the solids component from the separator to a selected location on the offshore facility.

20 Claims, 3 Drawing Sheets

SYSTEM AND METHOD FOR PROCESSING DRILLING CUTTINGS DURING OFFSHORE DRILLING

CROSS-REFERENCE TO RELATED APPLICATIONS

None

BACKGROUND OF THE INVENTION

1. Field of the Invention

The present invention relates to systems for processing return fluid and entrained cuttings.

2. Description of the Related Art

Hydrocarbons such as oil and gas are recovered from a subterranean formation using a wellbore drilled into the formation. When an oil well is drilled, a drilling fluid, commonly referred to as drilling mud, is used to lubricate and cool the drill bit and to carry away cuttings of rock and earth. Commonly, the drilling mud includes water as well as oil, an oil-based carrier, or a diesel-based fluid.

Oily drill cuttings often cannot be discharged directly into the environment due to their adverse effect upon the environment and, therefore, must be processed for disposal in costly disposal wells. Additionally, because of the great value of the residual oil and chemicals contained in them, it has been a common practice to treat the oil drill cuttings in order to produce a solid material that can be disposed into the environment surrounding the well site or returned into the well from which it came without injury to the environment or interference with the well.

One method of treating these oily drill cuttings has been through the use of a chemical washing system. In this system, the oily drill cuttings are treated with various chemicals, including detergents, with relatively intense mixing. Then, this mixture is resolved into relatively oil-free solids (i.e., the drill cuttings) and a recovered liquid phase which is a mixture of water, oil, and the detergents which were employed in the chemical wash system. Burial or re-injection then disposes of the solids. However, these solids may still contain sufficient oil and/or chemicals that, upon contact with bodies of water, such as surface waters, lakes or the ocean, produce unacceptable levels of toxins detrimental to preserving the environment in the best possible form. In addition, the liquid phase must be treated to separate the oil from the bulk water phase so that the water portion can be discharged or otherwise disposed without pollution problems. The separated oil and expensive drilling fluids are usually recovered and utilized for various uses such as fuel or be returned into the blending of additional oil based drilling muds and the like.

Conventional chemical wash procedures for treating oily drill cuttings have certain disadvantages, especially when they are to be employed on offshore drilling platforms. For example, large amounts of chemicals must be transported at great expense to offshore facilities. In addition, these offshore platforms do not have any surplus of steam, gas, electrical, or other energy sources. Thus, a procedure for treating the oily drill cuttings must be self-sufficient relative to the operations on the offshore platforms.

Centrifugal separators are widely used as a very efficient method for separating fluids from solids. In general, vertical, centrifugal separators such as is described in U.S. Pat. No. 5,256,289 include a housing containing a drive mechanism to which is connected both a flight assembly and a screen assembly. The separator further includes an inlet for induction of the material to be separated. Induced material is captured by the flight screen assembly, separation occurring as the material migrates downwardly with liquids or very small particles present on or in the material being forced outwardly through a fine screen into a space between the screen and the housing by centrifugal force. The majority of the liquids are then drawn off and the solids are generally ejected from an outlet assembly located below the rotor drive assembly. The outlet assembly usually is defined as a conical discharge bin for depositing the solids in a container or further conveyed to other locations for disposition, thereby making the dryer quite high.

In addition, the treatment procedure for the oily drill cuttings must be safe to operate, not require extensive retention time, operate without interference or hindrance to the drilling operations conducted on the offshore platform, while yet producing solids from the drill cuttings which can be disposed of safely and without any injury to the environment at the drilling site. In addition, the system for the treatment of oily drill cuttings at the drilling site, and especially on an offshore platform, must not require a constant supply of chemicals, fuel, nitrogen or other materials for its operation. The present invention addresses these and other drawbacks of the prior art.

SUMMARY OF THE INVENTION

In aspects, the present invention provides a drill cuttings processing system for use while drilling a wellbore at an offshore location. The processing system can be positioned on an offshore facility located on a surface of a body of water. The wellbore is drilled by a drill string conveyed into the wellbore from the offshore facility. During drilling, a fluid circulation system positioned on the offshore facility pumps drilling fluid via the drill string into wellbore. The drilling fluid cools and lubricates a drill bit coupled to the drill string and returns to the surface carrying drill cuttings and other debris from the wellbore. A return fluid processing system positioned on the offshore facility receives and processes the returning return fluid (or "return fluid").

In one embodiment, the fluid processing system includes a separator having an inlet receiving the return fluid, an accelerator coupled to the inlet that accelerates the return fluid, and a conical spinning member that receives the accelerated return fluid from the accelerator and applies a centrifugal force to the return fluid. The centrifugal force separates the return fluid into a substantially liquid component and a substantially solid component. The acceleration can be selected to provide the return fluid with a tangential velocity that substantially matches the rotational speed of the conical spinning member. The separator also has a liquid discharge port that discharging the substantially liquid component to a tank or pipe and a solids discharge opening that discharges the substantially solid component out of the separator. In one embodiment, a conveyance device transports the solids component from the separator to a selected location on the offshore facility. The conveyance device can include an auger. In some embodiments, the fluid processing system and the return fluid circulation system are sized to process at least sixty tons of return drill fluid per hour.

The fluid processing system can be configured to discharge the solids component with a sufficient purity to be discharged into the environment. Moreover, the liquids component can be pumped or conveyed back to the fluid circulation system for re-use in the wellbore. Thus, the fluid circulation system enhances both drilling operations and cuttings disposal activities.

It should be understood that examples of the more important features of the invention have been summarized rather broadly in order that detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals and wherein.

DESCRIPTION OF THE PREFERRED EMBODIMENTS

Figure 1:
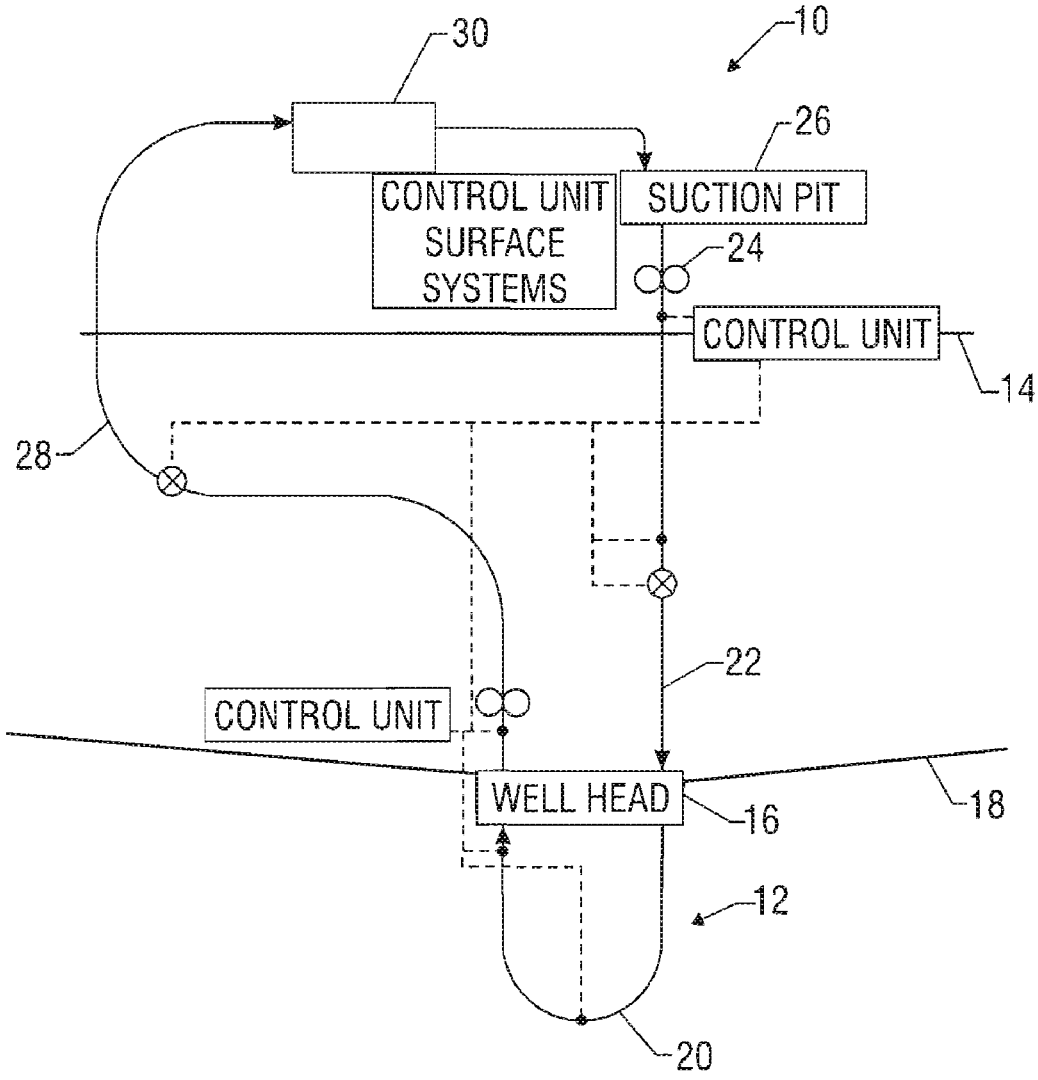
FIG. 1 is an elevation view of one embodiment of an offshore drilling system made in accordance with the present invention.

The present invention relates to devices and methods for processing return fluid recovered from the wellbore during drilling. The return fluid can be received directly from the wellbore or received after some form of initial treatment. Return fluid received directly from the wellbore could have a substantially liquid component with entrained drill cuttings. A treated or pre-processed return fluid can, in actuality, be a slurry having a substantial solids component and some liquids. For simplicity, the term "return fluid" as used herein generally refers to either treated or untreated fluid recovered from the wellbore during drilling. The present invention is susceptible to embodiments of different forms. There are shown in the drawings, and herein will be described in detail, specific embodiments of the present invention with the understanding that the present disclosure is to be considered an exemplification of the principles of the invention, and is not intended to limit the invention to that illustrated and described herein.

FIG. 1 shows a schematic elevation view of a drilling system 10 for drilling subsea or under water wellbores 12. The drilling system 10 includes a drilling platform 14, which may be a drill ship or another suitable surface work station such as a floating platform or a semi-submersible. Various types of work stations are used in the industry for drilling or performing other wellbore operations in subsea wells. A drilling ship or a floating rig is usually preferred for drilling deep water wellbores, such as wellbores drilled under several thousand feet of water. Offshore wells typically include wellhead equipment 16 deployed above the wellbore 12 at the sea bed or bottom 18. The wellhead equipment 16 includes known devices such as a blow-out-preventer stack, a lubricator and associated flow control valves, which have been omitted for simplicity. The subsea wellbore 12 is drilled by a drill bit carried by a drill string, which includes a drilling assembly or, a bottom hole assembly ("BHA") 20 at the bottom of a suitable tubing 22, such as continuous coiled tubing, drill pipe or other suitable jointed tubulars such as liner or casing. During drilling, a drilling fluid from a surface mud system is pumped under pressure down the tubing 22. The mud system can include a mud pump 24 and a mud pit 26. The fluid operates a mud motor in the BHA 20, which in turn rotates the drill bit. The drill bit disintegrates the formation (rock) into cuttings. The drilling fluid leaving the drill bit travels uphole through the annulus between the drill string and the wellbore carrying the drill cuttings. A return line 28 coupled to a suitable location at the wellhead 16 carries the fluid returning from the wellbore 12 to the sea level.

At the surface, a return fluid processing system 30 processes the return fluid by separating the cuttings and other solids from the returning fluid. Initially, the cuttings are commonly separated from the drilling fluid by devices such as shale shakers fitted on the drilling rig. The shakers capture the cuttings and large solids from the drilling fluid during circulation. A screen is fitted on each shaker of certain mesh size and is vibrated to facilitate separation of the majority of fluids from the solids. After this initial separation, the return fluid cuttings are processed in a processing device, discussed below, to further clean the cuttings. During an exemplary operation, the processing device separates liquids from the cuttings and separately discharges the solids and the liquid. The separated liquid, which can be subjected to further processing, is discharged into the pit 26 and recirculated into the wellbore 12. The solids (e.g., cuttings) are disposed of in an appropriate manner consistent with applicable regulatory rules. For example, In the U.S., the EPA has set the discharge limit to 6.9% by weight for I/O synthetics or better and 9.4% by weight for Esters or better. In other parts of the world, 5% and 10%, can apply respectively.

It should be appreciated that the circulation of drilling fluid plays an integral role in the overall efficiency of the drilling activity. For example, the volume of cuttings removed from the wellbore directly impacts the rate or penetration (ROP) and the size of the hole (i.e., diameter) that can be drilled. The more cuttings that can be removed from the wellbore, the faster the ROP and/or the larger the diameter of the hole that can be efficiently drilled. Furthermore, because space is at a premium on an offshore rig and drilling fluid is relatively expensive, it is most efficient to process and recirculate drilling fluid rather than constantly introducing new fluid into the wellbore. Thus, the operating capacity (e.g., flow rate) of the return fluid processing system 30 plays a significant role in the achieving a desired ROP and/or efficiently drilling a particular size of hole. That is, the greater the flow rate or volume capacity of the fluid processing system 30, the more flexibility the driller has in setting drilling rates or drilling a particular hole sizes.

Figure 2:
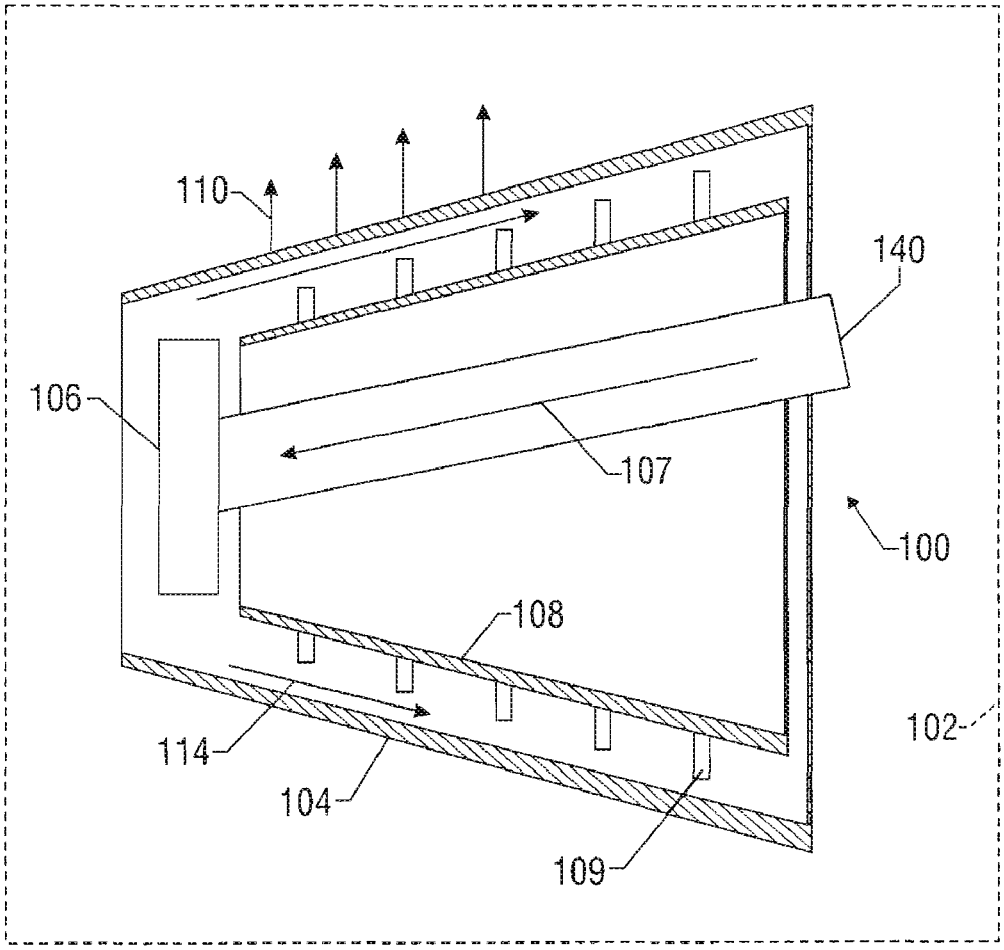
FIG. 2 schematically illustrates one embodiment of a fluid processing device made in accordance with the present invention.

Referring now to FIG. 2, there is schematically illustrated one embodiment of a fluid processing device 100 adapted for use in connection with the fluid processing system 30 of FIG. 1. In one embodiment, the fluid processing device 100 receives a slurry stream from an initial separation device such as a shaker and processes this slurry by separating the slurry into a liquid component and a solids component. The liquid component can include drilling fluid and additives that can be reused for further drilling. The solids component can include rock, earth and other debris recovered from the wellbore that will be disposed of in an appropriate manner. Commonly, this process is referred to as cuttings separation or drying. The fluid processing device 100 can be the exclusive mechanism for processing return fluid or used in conjunction with other devices to process return fluid in multiple stages.

Figure 3:
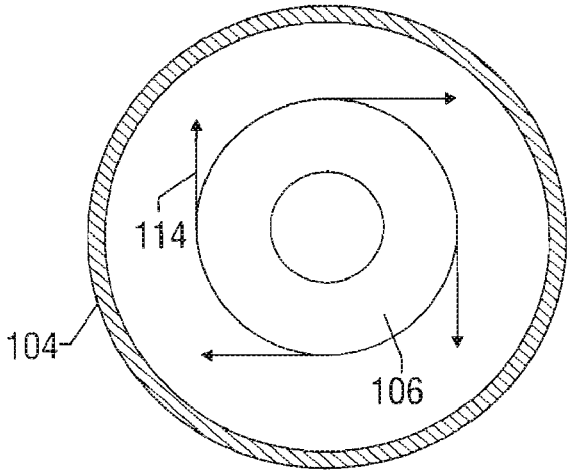
FIG. 3 schematically illustrates the flow of fluid from an accelerator made in accordance with one embodiment of the present invention.

In one embodiment, the fluid processing device 100 includes a housing 102 for receiving a horizontally aligned rotating basket 104, an accelerator 106 that directs drilling fluid into the rotating basket 104, and a scraper 108 that conveys drill cuttings across the basket 104. During operation, the accelerator 106 receives a return fluid or slurry 107 and directs the return fluid to one end of the rotating basket 104. The rotating basket 104 rotates at a high speed and thereby applies a centrifugal force to this return fluid. The centrifugal force separates the return fluid into liquids and solids. In one arrangement, the rotating basket 104 is a frustoconically shaped screen having perforations (not shown) sized to allow liquids to flow radially out of the basket 104 as shown with arrows 110. The scraper 108 is a rotating member concentrically disposed within the basket 104 that includes scraping elements 109. The scraping elements 109 can be a helical paddle or arms. The scraper 108 rotates at a slightly slower speed than the rotating basket 104. Due to the rotational speed mismatch between the basket 104 and the scraper 108, the scraping elements 109 effectively plow or push the solids across the interior surface of the basket 104 in the direction shown by arrow 114. As the return drilling fluid flows to the other end of the basket 104, liquids spin out of the return drilling fluid such that ultimately only solids remain in the basket 104. The solids then fall out of the basket 104. Prior art separators 100 having generally such a configuration have been utilized in processing coal and are made by Andritz-Bird, including horizontal centrifugal separators under Model Number H-900. Other exemplary separators are discussed in U.S. Pat. Nos. 6,910,411; 6,763,605; 6,752,273; and 6,640,912, which are hereby incorporated by reference for all purposes Referring now to FIGS. 2 and 3, the accelerator 106 accelerates and distributes the return drilling fluid entering the basket 104. In one embodiment, the accelerator 106 directs the drilling fluid onto the basket 104 such that the drilling fluid has primarily a tangential velocity 114 and a minimal radial velocity. That is, the accelerator 106 is configured to introduce return fluid onto the surface of the basket 104 with a tangential velocity that corresponds with the rotational speed of the basket 104. This matching of velocities presents at least two benefits. First, because the return drilling fluid is almost immediately at or near the rotational velocity of the basket 104, the drilling fluid is subjected to the maximum centrifugal force for nearly the entire time the drilling fluid spends in the basket 104. Thus, more liquid can be separated from the solids in the drilling fluid. Also, the surfaces of the basket 104 suffer less wear and tear because the drilling fluid and entrained solids do not slide along these surfaces. Thus, abrasive wear on the surfaces of the basket 104 is reduced. The distributed loading of the drilling fluid into the basket 104 also reduces wear on devices such as bearings, couplings and shafts. Suitable accelerators are discussed in U.S. Pat. Nos. 5,380,266 and 5,520,605, which are hereby incorporated by reference for all purposes. A suitable accelerator is made by Bird as the XL-PLUS® Technology.

Conventional separators for use in coal drying operations are unsuitable for offshore drilling operations because volume/flow rate capacities must be adequate to accommodate drilling operations. Moreover, the separated solids have to meet stringent regulatory requirements before they can be discharged into the environment. Accordingly, embodiments of the present invention include features and devices that provide enhanced flow rates or volume capacities.

Figure 4:
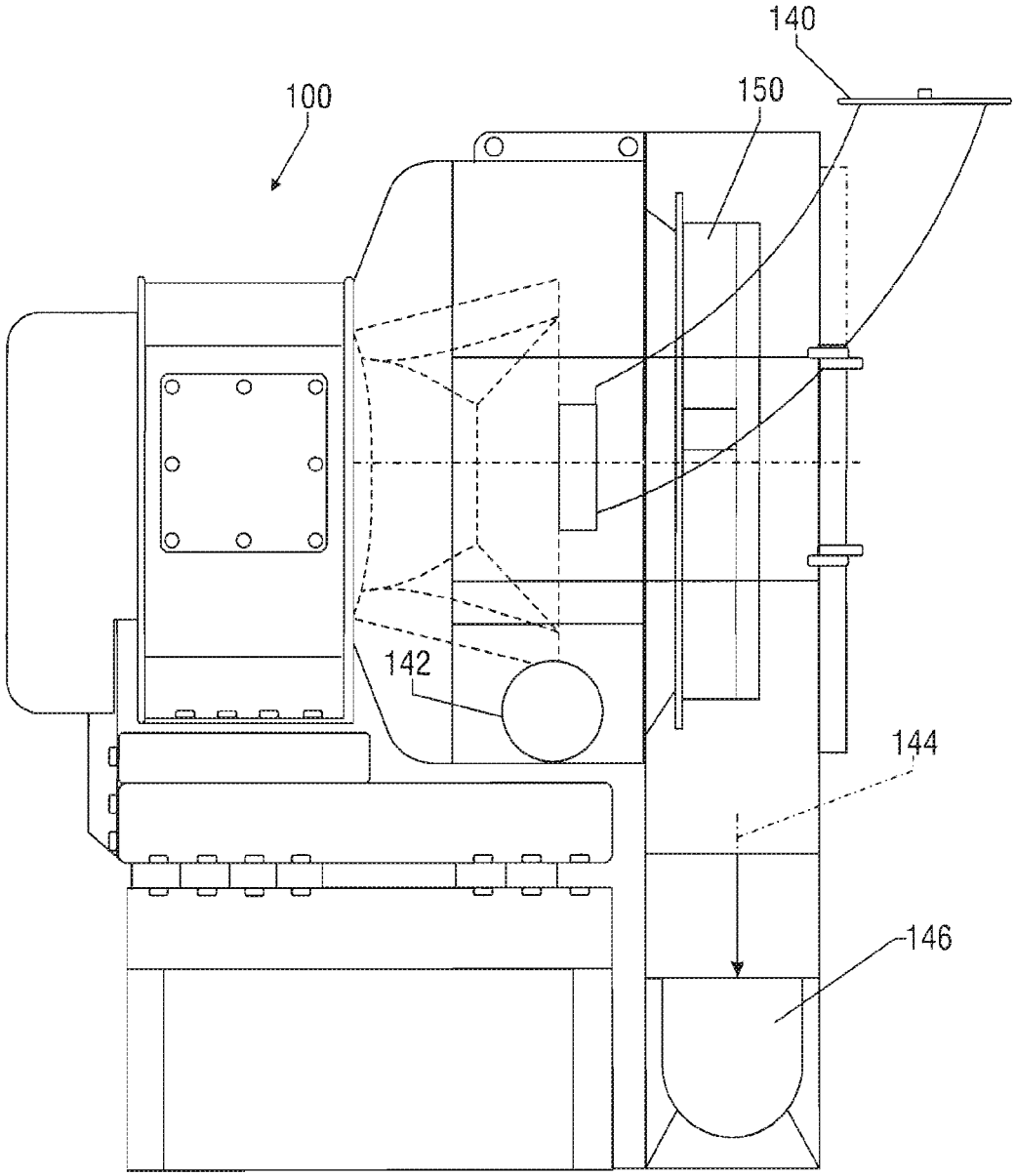
FIG. 4 is a side elevation view of one embodiment of a fluid processing made in accordance with the present invention.

Referring now to FIG. 4, there is shown an exemplary fluid processing device 100 adapted for use in an offshore drilling platform. The device 100 includes an inlet 140 adapted to receive return fluid, a fluid discharge 142 for discharging separated fluids, a solids discharge 144 for discharging separated solids, and an external solids conveyor 146. In one embodiment, the inlet 140, fluid discharge 142 and solids discharge 144 are sized to accommodate drilling rates and flow volumes typically associated with offshore drilling; e.g., forty to seventy tons per hour or greater. These devices are sized to accept return fluid during drilling such that drilling rates or wellbore hole diameter size do not have to be reduced to prevent overflowing the fluid processing device 100. Additionally, the speed of removal of solids from the fluid processing device 100 is increased by positioning the solids conveyor 146 adjacent the solids discharge 144. In one embodiment, the solids conveyor 146 is an auger that includes a helical shaft or member that moves loose material. Rotation of the helical shaft pushes the separated solids across the conveyor 146. The solids conveyor 146 can transfer the separated solids to a shuntline for eventual disposal. Other suitable conveyors include vacuum-based devices, solids progressive pump, reciprocating pumps and/or dense phase pneumatic conveyance devices. The fluid discharge 142 can discharge effluent to a volume tank or tanks via suitable hoses or pipes.

The fluid processing device 100 includes features and devices to increase the volume capacity. In some embodiments, the accelerator 110 includes a screen having an array of holes or discharge ports that direct flow onto the basket. At least some of these holes are enlarged in diameter to handle throughputs of returning drilling fluid in volumes associated with offshore drilling. The ports or hole diameters of conventional accelerators are suitable for coal purification operations but unsuitable for handling the relatively high volumes and flow rates associated with offshore drilling operations.

Other features and devices for increasing volume capacity include an enlarged raceway 150 is provided to facilitate the discharge of solids from the fluid processing device 100. The raceway 150 has an axially lengthen portion and wider diameter than prior art separators. Additionally, wiping elements or paddles (not shown) positioned within the raceway 150 are appropriately sized to sweep the enlarged raceway 150 to prevent the accumulation of solids within the raceway 120.

As indicated previously, U.S. regulatory rules require 6.9 percent OOC. Thus, the rotational speed of the rotating basket 106 should be selected to provide sufficient centrifugal force to provide drill cuttings meeting this requirement.

It should be understood that the terms "liquid" and "solid" should be construed as mostly liquid and mostly solid. A complete separation of liquids from solids is not contemplated. Moreover, in some embodiments, the fluid processing device can serve purposes other than processing drill cuttings. That is, the teachings of the present invention can be used to separate any type of liquid from any type of solid.

The teachings of the present invention can be utilized with a variety of drilling systems and system configurations, the details of which will be known to one skilled in the art. For example, one skilled in the art will understand that the system can include appropriate sensors distributed along the tubing, at the wellhead, in the wellbore and other locations. Moreover, equipment such as control units may be utilized to control drilling operations. One suitable offshore drilling system is discussed in commonly assigned U.S. Pat. No. 6,415,877, which is hereby incorporated by reference for all purposes. The teachings of the present invention can also be applied to onshore applications.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention. It is intended that the following claims be interpreted to embrace all such modifications and changes.

The invention claimed is:

1. An apparatus for processing drilling fluid returning from a wellbore ("return fluid"), comprising:

(a) an inlet receiving the return fluid;

(b) an accelerator coupled to the inlet, the accelerator accelerating the return fluid;

(c) a horizontally aligned spinning member receiving the accelerated return fluid from the accelerator, the spinning member applying a centrifugal force to the return fluid, the centrifugal force separating the return fluid into a substantially liquid component and a substantially solid component by flowing the substantially liquid component through perforations in the spinning member, wherein the accelerator accelerates the return fluid in a substantially tangential direction relative to a rotational axis of the spinning member;

(d) a liquid discharge discharging the substantially liquid component; and (e) a solids discharge discharging the substantially solid component.

2. The apparatus of claim 1 wherein the accelerator accelerates the fluid to a tangential velocity substantially corresponding to a rotational speed of the spinning member.

3. The apparatus of claim 1 wherein the spinning member includes a conical screen.

4. The apparatus of claim 1 further comprising a conveyance device receiving the solids component from the solids discharge, the conveyance device transporting the solids component away from the separator.

5. The apparatus of claim 1 further comprising a scraper positioned within the spinning member and configured to push the substantially solids component across the spinning member.

6. The apparatus of claim 4 wherein the conveyance device includes an auger.

7. A drilling system for drilling a wellbore at an offshore location, comprising:

(a) an offshore facility located on a surface of a body of water;

(b) a drill string conveyed into the wellbore from the offshore facility;

(c) a fluid circulation system positioned on the offshore facility conveying drilling fluid via the drill string into the wellbore; and (d) a fluid processing system positioned on the offshore facility, the fluid processing system receiving drilling fluid returning from the wellbore ("return fluid") and including a processing device comprising:

(i) an inlet receiving the return fluid;

(ii) an accelerator coupled to the inlet, the accelerator accelerating the return fluid;

(iii) a horizontally aligned spinning member receiving the accelerated return fluid from the accelerator, the spinning member applying a centrifugal force to the return fluid, the centrifugal force separating the return fluid into a substantially liquid component and a substantially solid component by flowing the substantially liquid component through perforations in the spinning member, wherein the accelerator accelerates the return fluid in a substantially tangential direction relative to a rotational axis of the spinning member;

(iv) a liquid discharge discharging the substantially liquid component; and (v) a solids discharge discharging the substantially solid component;

wherein the flow rate capacity of the fluid processing system substantially corresponds to the flow rate of the fluid circulation system.

8. The system according to claim 7 wherein the return fluid processing system and the fluid circulation system are sized to process at least sixty tons of return drill fluid per hour.

9. The system according to claim 7 further comprising a conveyance device adjacent the solids discharge, the conveyance device transporting the solids component to a selected location on the offshore facility.

10. The system according to claim 9 wherein the conveyance device includes an auger.

11. The apparatus of claim 5 wherein the scraper rotates at a slower speed than the spinning member.

12. A method of processing fluid returning from a wellbore, the fluid having a solids component and a liquid component, the method comprising:

(a) conveying the fluid from the wellbore to a horizontally aligned separator;

(b) accelerating the fluid in a substantially tangential direction relative to a rotational axis of the separator;

(c) spinning a screen to cause at least some of the liquid component to separate from the fluid by flowing through perforations in the screen; and (d) conveying the solids component out of the separator.

13. The method of claim 12 wherein the fluid is accelerated in substantially the same direction as the direction of spinning.

14. The method of claim 12 wherein the screen is a conical screen that is used to spin the fluid.

15. The method of claim 12 further comprising conveying the solids component from the separator using a conveyance device.

16. The method of claim 15 wherein the conveyance device includes an auger.

17. The method of claim 15 further comprising disposing of at least some of the solids component in a body of water.

18. The method of claim 15 further comprising drilling the wellbore; and pumping the processed liquid component into the wellbore during drilling.

19. The method of claim 12 wherein the accelerated fluid has substantially no radial component.

20. The method of claim 12 wherein the accelerated fluid has a tangential velocity that substantially matches a rotational velocity of the separator.

* * * * *